United States Patent [19]

Richter et al.

[11] 4,056,429

[45] Nov. 1, 1977

[54] METHOD FOR COUNTER-CURRENT TREATMENT OF CELLULOSE FIBER MATERIAL

[75] Inventors: Johan C. F. C. Richter, St. Jean Cap Ferrat, France; Per Tyke Christenson; Ole Johan Richter, both of Karlstad, Sweden

[73] Assignee: Kamyr Aktiebolag, Karlstad, Sweden

[21] Appl. No.: 707,070

[22] Filed: July 20, 1976

Related U.S. Application Data

[63] Continuation of Ser. No. 423,812, Dec. 11, 1973, abandoned.

[30] Foreign Application Priority Data

Dec. 11, 1972 Sweden ..... 16090/72

[51] Int. Cl.[2] ..... D21C 3/24

[52] U.S. Cl. ..... 162/17; 162/52; 162/237; 210/70

[58] Field of Search ..... 23/270 R; 162/17, 52, 162/60, 237, 243, 246, 251; 210/20, 70, 189, 205, 207, 208, 209, 213, 219, 268, 73 R

[56] References Cited

U.S. PATENT DOCUMENTS

| | | | |
|---|---|---|---|
| 1,283,364 | 10/1918 | Trent | 23/271 |
| 2,781,301 | 2/1957 | Payne | 210/189 |
| 2,904,506 | 9/1959 | Penick | 210/189 |
| 3,567,573 | 3/1971 | Case | 162/60 |
| 3,814,664 | 6/1974 | Carlsmith | 162/237 |

*Primary Examiner*—Wilbur L. Bascomb, Jr.
*Assistant Examiner*—Ivars Cintins
*Attorney, Agent, or Firm*—Cushman, Darby & Cushman

[57] ABSTRACT

In counter-current treatment of cellulosic fiber material it is known to have strainers for separation of liquid from the fiber material. In this invention strainers are omitted by introducing pretreated sinking fiber material through an inverted funnel into a liquid filled tank passing treatment liquid counter-currently to the fiber material and extract liquid from a liquid room above the surface of the fiber material and above the open lower end of said funnel. The tank may be operated at atmospheric or at higher pressures to suit the conditions.

4 Claims, 2 Drawing Figures

METHOD FOR COUNTER-CURRENT TREATMENT OF CELLULOSE FIBER MATERIAL

This is a continuation of application Ser. No. 423,812 filed Dec. 11, 1973 and now abandoned.

BACKGROUND AND SUMMARY OF THE INVENTION

The invention relates to such treatment of cellulose fiber material, e.g. chips, suspended fibers, sawdust and similar, which takes place in the cellulose industry with e.g. impregnated, prehydrolized or cooked fiber material before or after defibration, unbleached or bleached fiber suspensions etc., mainly consisting in that the fiber material during a stage of the manufacture through steaming, impregnation, cooking or other treatment reaches a specific weight higher than that of a liquid in which the fiber material is suspended and even higher than a treatment liquid, and by its sinking movement by its own weight, e.g. through a container, is met by an upward flowing treatment liquid and that liquid is separated and discharged from the upper end of the container.

For the method according to the invention the essential characterization consists in the omission of screens or strainers during the separation of fiber material and liquid. Thus, the fiber material is fed continuously through an inverted into the upper part of a treatment container filled with a suspension liquid and after piling up to a level just underneath the invested funnel opening and after a certain retention time in the container, the treated fiber material is continuously discharged from the container lower end. Above the fiber material surface there is a certain liquid volume. Furthermore, treatment liquid is added close to the bottom of the container and this liquid is flowing upwards countercurrently to the fiber material flow in order to displace the suspension liquid. Upflowing liquid is separated from the surface of the fiber material into the liquid volume around the inverted funnel. By choosing proper funnel dimensions the upflow liquid velocity around the funnel can be kept relatively low so that even light fiber material particles will not tend to be carried or floated upwards. Also the liquid outlets from said volume should be located at a relatively high level compared to the inverted funnel outlet in order to stabilize the liquid flow. Thus, fiber material particles will get time to sediment or settle on the surface of the other fiber material and thereafter follow it downwards.

The commonly known problem within the cellulose industry with plugged strainers in connection with separation of fiber material and liquid can therefore by means of such treatment of the fiber material be considered solved. The invention is even directed at an apparatus suitable for the working of the method.

BRIEF DESCRIPTION OF THE DRAWINGS

The invention will be more closely described below with reference to enclosed drawing wherein FIG. 1 schematically and in vertical section shows a preferred design of an apparatus for carrying out such counter-current displacement treatment of fiber suspensions

DETAILED DESCRIPTION OF THE INVENTION

Figure 1:
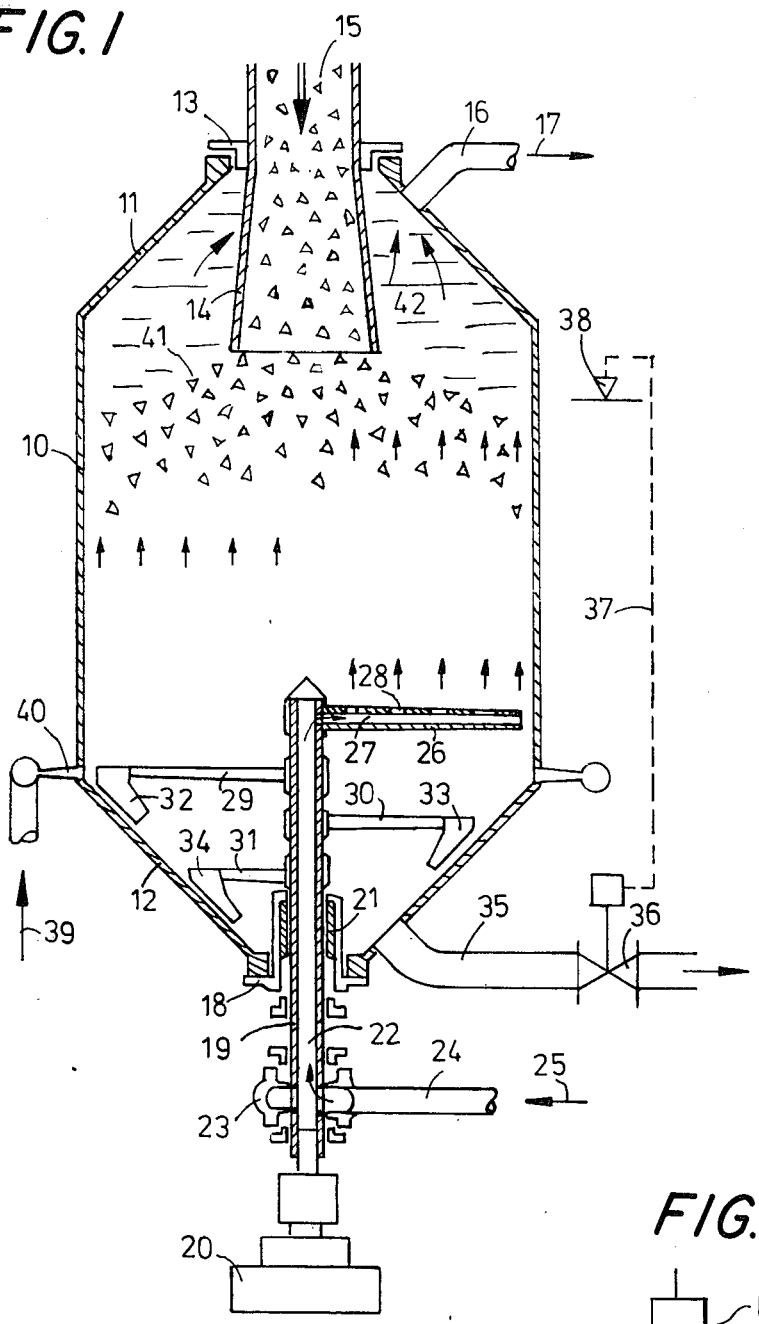

The shown treatment container is made as a tower with cylindrical wall 10 and with a conically shaped top part 11 and a conical lower part 12. The top part is equipped with a cover 13, to which is fastened a vertical, straight or downward somewhat expanding inlet inverted funnel 14 with completely open lower end through which fiber material 15 is fed into the container. In the container top part above said inverted funnel opening is arranged one or more liquid outlets indicated by pipe 16 through which displaced liquid 17 can leave the container. The container bottom part is equipped with a lid 18, through which a vertical shaft 19 is arranged. The shaft is rotatable by means of a driving device 20 and is equipped with a sealing device, e.g. a packing box 21. Said shaft 19 is hollow and the inside chamber 22 is at its lower end by means of a suitable coupling 23 of e.g. rotor type, connected to a pipe 24 for admission of treatment liquid 25. At the upper end of chamber 22 is arranged one or more radial arm-like devices 26 equipped with hollow chamber 27 and openings 28 for distribution of liquid.

The treatment liquid 25 is fed in through the inlet 24 and reaches first the hollow chamber 22, thereafter the hollow chamber 27 and is thereafter flowing out through the openings 28. During rotation of the shaft 19, the arm 26 is also rotating and treatment liquid is distributed over the cross-section of the container. To said rotating shaft 19 is also fastened a number of arms 29, 30, 31 with e.g. leaf-like shovels 32, 33, 34 for stirring and feeding out of the fiber material which then leaves the container through the outlet 35.

The fiber material level in the container can be controlled by a level meter 38 which through a connecting line 37 is controlling the valve 36 on the outlet line 35. Any desired dilution liquid 39 can be added through a number of evenly distributed inlets 40 around the periphery of the container.

During operation, the fiber material together with its suspension liquid enter through the inverted funnel 14 into the container which is full of liquid or at least has a liquid level above the outlet 16. Due to its sinking tendency the fiber material will form an angled surface 41 corresponding to the natural angle of repose. Said free surface 41 will then represent the outlet area of the fiber material from which upflowing liquid is separated without strainers.

The entering fiber material can also be distributed by means of e.g. a rotating scraper (not shown). A possible design of such a scraper can consist of an elongation of shaft 19 upwards to the neighborhood of the inverted funnel 14. There the shaft can be equipped with one or more scraper arms which are stretching out towards the container periphery. During the rotation of the shaft the incoming fiber material will be distributed over the cross-section of the container and it will then form a more or less horizontal surface. This can be of positive effect to the separation operation.

During its continuous flow downwards in the container the fiber material is met by an upward, countercurrently flowing treatment liquid 25 entering through inlet 24, chamber 22, and chamber 27. This liquid flows out through the openings 28 and is by means of the rotation of shaft 19 distributed over the cross-section area of the container. The treatment liquid can also be distributed in other ways, such as e.g. known from continuous digesters, by adding treatment liquid through a central pipe in the container and flowing radially outwards to separation strainers in the container wall. The quantity of treatment liquid added is balanced with liquid entering and leaving together with the fiber material and liquid added for dilution as well as liquid extracted in such a quantity that treatment liquid is moving upwards counter-currently to the fiber material at a sufficiently low velocity so controlled that said fiber material will not be carried upwards, and furthermore, the outlet 16 for discharge of liquid is arranged at a level so high above the fiber material level and thereby above the inverted funnel lower end, e.g. at a height not less than one fifth of the container diameter, that the liquid chamber 42 gets sufficient cross-section and volume to permit eventual fine particles of fiber material in the liquid to sink downwards, settle and then follow the other fiber material down through the container, i.e. the upflow liquid velocity must be lower than the sinking velocity of the fiber material. In this respect also the cross-section area of the inverted funnel 14 has to be taken in consideration. Preferably it should not exceed one fifth of the container cross-section area. As a result, particles of the fiber material will not reach up to the wall opening of outlet 16 and accordingly no strainers will be needed for separation of liquid and fiber material at the outlet. To operate without strainers is of very great advantage since, as mentioned, especially in connection with fiber material, strainers often have a tendency to plug and thereby cause great problems and possible operation stops.

In the figure, the container 10 itself is shown open through the inlet funnel, or in other words only exposed to the atmospheric pressure, but it is very possible to make the container part of a system of equipment in which it is desirable to maintain a certain pressure during the treatment time. The fiber material can then by known methods be fed into the container by means of e.g. a rotating feeding apparatus or plug feeder, pump, screw or similar. A system working under pressure will not to any considerable degree influence the discharge from the container, since it is possible, as known from continuous digesters, e.g. to blow the content of the pressurized container out through the outlet 35 and regulate the flow by means of a valve 36 for further blowing to suitable cyclon or any treatment apparatus. Due to compression the pressure will also make the fiber material sink faster, especially if it contains air or gases.

Figure 2:
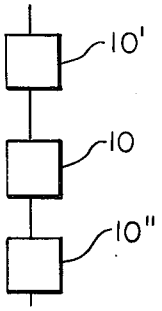
FIG. 2 is a schematic showing of several vessels connected together in series.

In the figure, the container itself is furthermore shown as a separate unit, but the container can also constitute an intergrated part of an apparatus with or without superatmospheric pressure for certain treatment sequence or series of treatments of the fiber material in such a way that the container is e.g. preceded by a similar container (see 10' in FIG. 2) for certain pretreatment of the fiber material and/or is succeeded by a similr container (see 10" in FIG. 2) for certain after-treatment of the fiber material, or that the container constitutes a part of a greater container in which the fiber material can undergo two or more treatment stages after each other in the greater container.

The above description of the invention concerns a preferred embodiment, but the invention can be varied within the scope of the following patent claims.

What is claimed is:

1. A method of counter-current treatment of cellulosic fiber material in a vessel substantially filled with liquid, said vessel having lower and upper ends, comprising the steps of:

a. introducing fiber material in a substantially continuous flow into the liquid in said vessel through an inlet having an open lower end, said inlet being located centrally in said vessel at the upper end thereof and vertically extending downwardly into said vessel, b. establishing a fiber material column upper level at a point below the position of said inlet lower end;

c. discharging fiber material through an outlet in the lower end of the vessel at a given rate so that the level of said material column is maintained substantially constant, individual fiber material particles gradually sinking downwardly from the top of said column to said outlet;

d. introducing treatment liquid into said vessel with an upwardly directed velocity component so that said treatment liquid flows upwardly through said material column toward the upper end of said vessel;

e. the velocity of the upflowing treatment liquid being correlated with the dimensions of the inlet relative to the vessel dimensions so that fiber material in said column will not flow upwardly with said upflowing liquid to said liquid outlet; and f. discharging treatment liquid, as well as displaced liquid introduced with said fiber material entrained by the upwardly flowing treatment liquid, through an unscreened outlet at the upper end of said vessel at a point above the lower end of said inlet;

g. whereby separation of treatment liquid and material takes place without the use of strainers.

2. A method as recited in claim 1 wherein the vessel is maintained substantially at atmospheric pressure.

3. A method as recited in claim 1 wherein the vessel is maintained at superatmospheric pressure.

4. A method of counter-current treatment of cellulosic fiber material as recited in claim wherein three separate vessels are provided, and comprising the further steps of repeating steps (a) – (g) for each of said vessels, the fiber material being discharged from one vessel into the next succeeding vessel.

* * * * *

UNITED STATES PATENT OFFICE

CERTIFICATE OF CORRECTION

Patent No. 4,056,429 Dated November 1, 1977

Inventor(s) Johan C.F.C. Richter et al.

It is certified that error appears in the above-identified patent and that said Letters Patent are hereby corrected as shown below:

In Column 1, line 30, insert --funnel-- after "inverted"; line 32, change "invested" to --inverted--; Column 4, line 2, change "similr" to --similar--; line 51, insert --1-- after "claim".

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*